US008070230B2

(12) United States Patent
Krob et al.

(10) Patent No.: US 8,070,230 B2
(45) Date of Patent: Dec. 6, 2011

(54) CHAIR HAVING AN INCLINABLE BACK REST

(75) Inventors: Andreas Krob, Heiden AR (CH); Joachim Brüske, Berlin (DE)

(73) Assignee: Thonet GmbH, Frankenberg (DE)

( * ) Notice: Subject to any disclaimer, the term of this patent is extended or adjusted under 35 U.S.C. 154(b) by 437 days.

(21) Appl. No.: 12/378,571

(22) Filed: Feb. 17, 2009

(65) Prior Publication Data

US 2009/0212617 A1 Aug. 27, 2009

(30) Foreign Application Priority Data

Feb. 27, 2008 (DE) ..... 10 2008 011 309

(51) Int. Cl.
*A47C 1/24* (2006.01)
*A47C 3/22* (2006.01)

(52) U.S. Cl. ..... 297/300.5; 297/300.2

(58) Field of Classification Search .... 297/300.2–300.5, 297/301.2, 321, 340, 362, 362.12
See application file for complete search history.

(56) References Cited

U.S. PATENT DOCUMENTS 2,497,395 A * 2/1950 Cramer, Sr. ..... 297/318
4,386,805 A * 6/1983 Boisset ..... 297/362
4,744,600 A * 5/1988 Inoue ..... 297/300.5
4,796,952 A * 1/1989 Piretti ..... 297/300.5
4,966,411 A * 10/1990 Katagiri et al. ..... 297/300.7
4,988,145 A * 1/1991 Engel ..... 297/300.4
5,052,753 A * 10/1991 Buchacz ..... 297/300.3
5,476,306 A * 12/1995 Golynsky ..... 297/362.12
5,918,935 A * 7/1999 Stulik et al. ..... 297/300.5
2007/0273189 A1 11/2007 Gehner et al.

FOREIGN PATENT DOCUMENTS

CA 2149898 A1 * 3/1995
DE 10 2006 023 981 A1 12/2007
DE 10 2008 011 309.3-14 2/2008

* cited by examiner

*Primary Examiner* — David Dunn
*Assistant Examiner* — Tania Abraham
(74) *Attorney, Agent, or Firm* — Fay Sharpe LLP

(57) ABSTRACT

A rotatable office chair comprises at least two seat carriers, each further comprising an upper arched guide and a lower arched guide, and at least two back rest carriers, each further comprising a restrictedly guided region, and a back rest arranged on back rest carriers, wherein the restrictedly guided region of the at least one back rest carrier is guided between the upper arched guide and the lower arched guide of the at least one seat carrier, thus allowing the at least one back rest carrier to be inclined relative to the seat carrier, wherein the upper arched guide and the lower arched guide are embodied at least in certain regions as an arc of a circle portion and wherein the arc of a circle portion of the upper arched guide and the arc of a circle portion of the lower arched guide have the same center of a circle.

11 Claims, 7 Drawing Sheets

CHAIR HAVING AN INCLINABLE BACK REST

This application claims the priority benefit of pending German application No. 10 2008 011 309.3, filed Feb. 27, 2008, the disclosure of which is included in its entirety herein.

The invention relates to a chair or armchair, in particular an office chair or armchair having an inclinable back rest.

In the case of conventional chairs having an inclinable back rest, an upwardly or downwardly directed movement relative to the seat surface takes place during the inclining of the back rest. Resulting therefrom, a relative movement likewise occurs between the inclining back rest and the back of a user of the chair. The friction occurring as a result is undesirable, as it on the one hand can cause an unpleasant feeling in the user of the chair and on the other hand leads to upper parts of the user's clothing being displaced, for example to a shirt being drawn out of a pair of trousers. This property of conventional chairs having an inclinable back rest restricts the comfort of use of these chairs.

It is therefore the object of the invention to provide a chair or armchair which on the one hand displays increased comfort of use and on the other hand is simple and inexpensive to manufacture.

The object is achieved by a chair according to claim 1. Preferred embodiments form the subject-matter of the dependent claims.

Chair According to the Invention

The present invention relates to a chair or armchair, in particular a rotatable office chair, comprising:

at least two seat carriers, each further comprising an upper arched guide and a lower arched guide;

at least two back rest carriers, each further comprising a restrictedly guided region;

a back rest arranged on the back rest carriers, wherein the restrictedly guided region of the back rest carriers is in each case guided between the upper arched guide and the lower arched guide of the corresponding seat carriers, thus allowing the back rest carriers to be inclined relative to the seat carriers, wherein the upper arched guide and the lower arched guide are embodied at least in certain regions as an arc of a circle portion and wherein the arc of a circle portion of the upper arched guide and the arc of a circle portion of the lower arched guide have the same centre of a circle H.

The office chair further comprises a base carrier;

at least one pull spring lever which is articulated to the seat carrier by means of a rear seat coupling shaft;

at least two coupling levers which are articulated to the seat carrier by means of a front seat coupling shaft, wherein the at least one pull spring lever is articulated by means of a main shaft and the at least two coupling levers are articulated to the base carrier by means of a base coupling shaft;

at least two pull rods which are arranged in an articulated manner on the at least one back rest carrier and at least two pull levers which are arranged on the main shaft and which are each articulated to the at least two pull rods.

Definition of Terms

To facilitate understanding of the invention, a large number of terms will be defined hereinafter by way of example.

The chair can be arranged on a flat floor area. For unambiguous description of directions and geometrical relations, the following description will assume that the flat floor area is spanned by the two orthogonal direction vectors of the x and y direction of a Cartesian coordinate system. In particular, the x direction coincides substantially with the viewing direction of a user of the chair, i.e. the x direction points forward. The y direction stands perpendicular on the x direction and points, viewed substantially from the user, toward the left. Perpendicularly thereto, i.e. perpendicularly to the floor area, the z direction extends upwards, i.e. counter to the direction of gravity.

Direction(s) of extension and/or displacement can be specified in relation to the orthogonal Cartesian coordinate system thus defined. All uses in the following description of the term "substantially" in relation to a specified direction mean in particular that the direction to be specified differs from the aforementioned reference direction by less than approximately ±20 degrees, preferably by less than approximately ±15 degrees, more preferably by less than approximately ±10 degrees, and particularly preferably by less than approximately ±5 degrees, in particular by less than approximately ±2 degrees. The term "substantially" can in particular describe a slight difference from a target value, in particular a difference within the limits of manufacturing accuracy and/or within the limits of the necessary accuracy, so that an effect is preserved such as is present in the case of the target value. The term "substantially" can therefore include a difference of less than approximately 30%, less than approximately 20%, less than approximately 10%, less than approximately 5%, less than approximately 2%, preferably less than approximately 1% from a target value or target position, etc. The term "substantially" comprises the term "identical", i.e. without difference from a target value, a target position, etc.

All uses in the following description of the term "approximately" in relation to a quantity specified in the degree unit of measure mean in particular that the direction to be specified differs from the aforementioned reference direction by less than ±15 degrees, and preferably by less than ±10 degrees, more preferably by less than ±5 degrees, particularly preferably by less than ±2 degrees, in particular by less than ±1 degree.

The aforementioned positions and directions are exemplary and serve in particular as a reference for describing, for example, sides and extensions of the chair and/or for determining directions in order for example to specify coordinates which can be defined or determined unambiguously. If appropriate, use may also be made of other positions or another coordinate system.

In the above-described Cartesian coordinate system, a seat carrier extends substantially parallel to the floor area. Let the longitudinal extension S of a seat carrier be in this case substantially the spatial extension in the viewing direction of the user of the chair, i.e. oriented substantially along the x direction. The transverse extension, which extends, viewed substantially from the use of the chair, from right to left, i.e. substantially along the y direction, is oriented substantially perpendicularly to the longitudinal extension S of a seat carrier. A seat surface arranged on the seat carriers extends substantially parallel to the floor area. In particular, the seat surface extends substantially between two seat carriers, wherein the seat carriers can be arranged along the viewing direction of the user of the chair at the right and left edge region of the seat surface. Preferably, the seat surface is an extendable or resilient covering between two seat carriers.

The back rest extends in an upright position substantially perpendicularly to the floor area and substantially parallel to a surface spanned by the y and z direction. Let the longitudinal extension R of the back rest be in this case substantially the spatial extension along the vertebral column of the user of the chair, i.e. substantially along the z direction. The transverse extension of the back rest, which extends, viewed substantially from the user of the chair, from right to left, i.e. substantially along the y direction, is oriented substantially perpendicularly to the longitudinal extension R of the back rest. The term "first position", such as it is used in the sense of the present invention, describes for example the state or the position of one or more components, in particular of the seat carrier and the back rest. The term "first position" describes in particular that position when the back rest is in an upright position. In other words, the first position corresponds to that position which the chair is in when a user wishes to sit upright on it.

The term "second position", such as it is used in the sense of the present invention, describes for example a state or position of the aforementioned components, in particular of the back rest, that differs from the aforementioned state or the aforementioned position. In contrast to the first position, in the second position, the back rest is inclined further backward, i.e. inclined counter to the x direction. The term "second position", such as it is used in the sense of the present invention, thus describes in particular a position in which the back rest is at maximum inclination. For example, the second position can be reached by applying a force on the back rest counter to the x direction. Owing to the applied force, the back rest in particular moves, for example from the first to the second position. In this case, the components, in particular the back rest, can be brought into any intermediate position between the first and the second position and preferably be fixed in this intermediate position. Particularly preferably, the chair is embodied so as to be able to be reset, i.e. it is designed in such a way that it returns substantially back to the first position after the action of a force on the back rest counter to the x direction.

Advantageously, no upwardly or downwardly directed movement relative to the seat surface takes place during the movement of inclination of the back rest relative to the seat carrier. Resulting therefrom, no relative movement between the inclining back rest and the back of the user of the chair occurs either, as a result of which the re-inclining of the back rest does not lead to a displacement of individual upper clothing items of the user of the chair relative to one another. Advantageously, the comfort of use of a chair according to the invention is therefore increased relative to conventional chairs.

Advantageously, the seat carrier is inclinable relative to the base carrier, wherein the tilt axis of the seat carrier coincides in particular substantially with the y direction. Particularly preferably, the base carrier is arranged on a chair foot and in particular not inclinable relative to the floor area.

Particularly preferably, the chair can comprise two or more pull spring levers and three or more coupling levers, wherein in particular the pull spring levers and the coupling levers are each arranged on the right and left side of the seat carrier.

As a result, the central space below the seat carrier advantageously remains free. In particular, the minimum distance or the height of the free space between the lower edge of the seat carrier and the upper edge of the base carrier is greater than approximately 1 cm, greater than approximately 2 cm, particularly preferably greater than approximately 5 cm and in particular greater than approximately 10 cm.

Furthermore, the pull rods are designed to accommodate both tensile and compressive loads in order to actuate or to displace the back rest by pulling or pushing in two directions. In particular, the pull rods are substantially rigid. Alternatively, the pull rods could also be designated as push rods or as pull/push rods. Particularly preferably, the chair can have three, four, five, six or more pull rods and three, four, five, six or more pull levers, wherein the pull rods and pull levers are each arranged on the right and left side of the seat carrier. In particular, the pull rods can be arranged substantially along the longitudinal extension S of the seat carrier at the outer sides of the seat carrier or in pull rod channels, so that the pull rods do not influence a closed contour of the seat carrier.

Preferred Embodiments of the Chair

Preferably, the upper arched guide, the lower arched guide and the back rest carrier are designed in such a way that the back rest carrier and the back rest can be moved exclusively along a circular path about the centre of the circle H.

Advantageously, the distance of individual regions of the back rest from the centre of the circle H remains constant during the rotational movement of the back rest, i.e. no translatory movement of the back rest or individual regions thereof takes place in a radial direction emanating from the centre of the circle H, as a result of which the position of the pelvis of the user of the chair does not move away from the back rest. Therefore, the pelvis and the sacral vertebrae of the user of the chair are advantageously supported at different inclinations of the back rest. In particular as the lower region of the back rest substantially does not move away from the pelvis, rearward rotation of the pelvis is avoided. The consequence of rotation of the pelvis is a "hunchback posture" which loads in particular the spinal discs of the lumbar vertebrae. Accordingly, this preferred embodiment of the chair is particularly gentle on the back.

Preferably, the seat carrier and the back rest are designed in such a way that the pivot point D of the hip joint of a user of the chair coincides substantially with the spatial position of the centre of the circle H. Preferably, the distance between H and D is less than approximately 5 cm, particularly preferably less than approximately 3 cm and in particular less than 2 cm. Advantageously, all regions of the pelvis and the vertebral column are in this case supported in all positions of inclination and during the movement of inclination of the back rest.

Preferably, the distance between the floor area on which the chair is standing and the front seat coupling shaft is variable or alterable during inclination of the back rest carriers and/or the seat carriers. In particular, the front seat coupling shaft is arranged on the coupling levers in such a way that the distance changes during rotation of the coupling levers. Particularly preferably, the distance of the seat coupling shaft from the floor area is reduced when the seat carriers or the seat surface and/or the back rest are inclined backward.

Advantageously, the distance between the seat surface front edge and the floor area remains as a result substantially constant, so that the region of the lower thigh or the knee region is substantially not raised by the front seat surface when the user of the chair reclines. Advantageously, this avoids pressure on the lower thigh and the supply of blood to the lower leg is not restricted, thus increasing sitting comfort.

Preferably, the chair mechanism is embodied so as to be substantially mirror-symmetrical to a plane in the x-z direction running through the centre axis of the chair foot. In this case, the chair mechanism comprises in particular the seat carriers, the at least one pull spring lever and the coupling levers. More preferably, the chair mechanism comprises the pull levers and the pull rods and also in particular the back rest carriers.

Advantageously, the mirror-symmetrical embodiment of the chair mechanism leads to increased freedom from twisting of the individual components, as the acting forces are distributed symmetrically and twisting or torsion forces compensate for one another in the first approximation. As a result, the overall chair mechanism can advantageously be manufactured with low material consumption and a slimmer design is facilitated.

Preferably, the at least two coupling levers each have a first coupling means which is designed to enter into engagement with a second coupling means of one of the at least two pull levers and/or to be joined together in a force-transmitting manner.

Preferably, the first coupling means is embodied as a series of equidistant projections or as a series of equidistant recesses. In particular, the projections of the first coupling means are embodied to engage with corresponding recesses in the second coupling means. Alternatively, the recesses in the first coupling means are embodied in such a way that projections of the second coupling means can engage therewith.

Preferably, the first coupling means is embodied as a row of teeth or as an arc of a circle portion of a gear wheel. In particular, the second coupling. means is in this case embodied as a corresponding counterpart row of teeth or gear wheel portion, so that in particular both coupling means are joined together in a force-transmitting manner.

Preferably, the seat carrier is inclinable about a tilt axis, so that a seat angle $\beta$ of from approximately 70 to approximately 110 degrees, more preferably from approximately 80 to approximately 100 degrees, is enclosed between the z direction and the longitudinal extension S of the seat carrier. Particularly preferably, the seat angle $\beta$ is in a range of from approximately 85 to approximately 95 degrees. In other words, the longitudinal extension S of the seat carrier runs substantially along the x direction and is inclinable to a limited degree relative to the x direction.

Preferably, the back rest is inclinable about a tilt axis, so that a back rest angle $\gamma$ of from approximately 0 to approximately 55 degrees is enclosed between the z direction and the longitudinal extension R of the back rest. Particularly preferably, the back rest angle $\gamma$ is in a range of from approximately 5 to approximately 40 degrees.

Preferably, the changes in the seat angle $\Delta\beta$ and the changes in the back rest angle $\Delta\gamma$ are at a constant ratio to one another, wherein the ratio $\Delta\gamma/\Delta\beta$ is between approximately 2 and approximately 4. In other words, the inclination of the back rest takes place together with the inclination of the seat carrier. If for example the back rest is brought from a first position having a back rest angle of 5 degrees to a second position having a back rest angle of 35 degrees, then $\Delta\gamma$ is equal to 30 degrees. In the case of an exemplary ratio $\Delta\gamma/\Delta\beta$ of 3, the changes in the seat angle $\Delta\beta$ are accordingly 10 degrees. As a result, the thighs and the floor of the pelvis are also inclined backward through 10 degrees and the opening angle $\alpha=\beta+\gamma$ between the seat carrier and the back rest is increased by 20 degrees. Particularly preferably, the ratio $\Delta\gamma/\Delta\beta$, is between approximately 2.2 and approximately 3.7, between approximately 2.5 and approximately 3.5, between approximately 2.7 and approximately 3.3 and in particular approximately 3.

The present invention is not limited to the foregoing embodiments described by way of example. On the contrary, individual elements and/or features of each aspect described and/or each embodiment described having individual elements and/or features of the further aspects and/or further embodiments can be combined with one another in any desired manner and thus further aspects and/or embodiments be formed.

DESCRIPTION OF THE FIGURES

FIG. 1 is a perspective view of the mechanism of a first embodiment of a chair 1. The chair 1 comprises a chair foot 2 which is preferably height-adjustable, a base carrier 3, two seat carriers 4, two back rest carriers 5 and a back rest 6.

Figure 1:
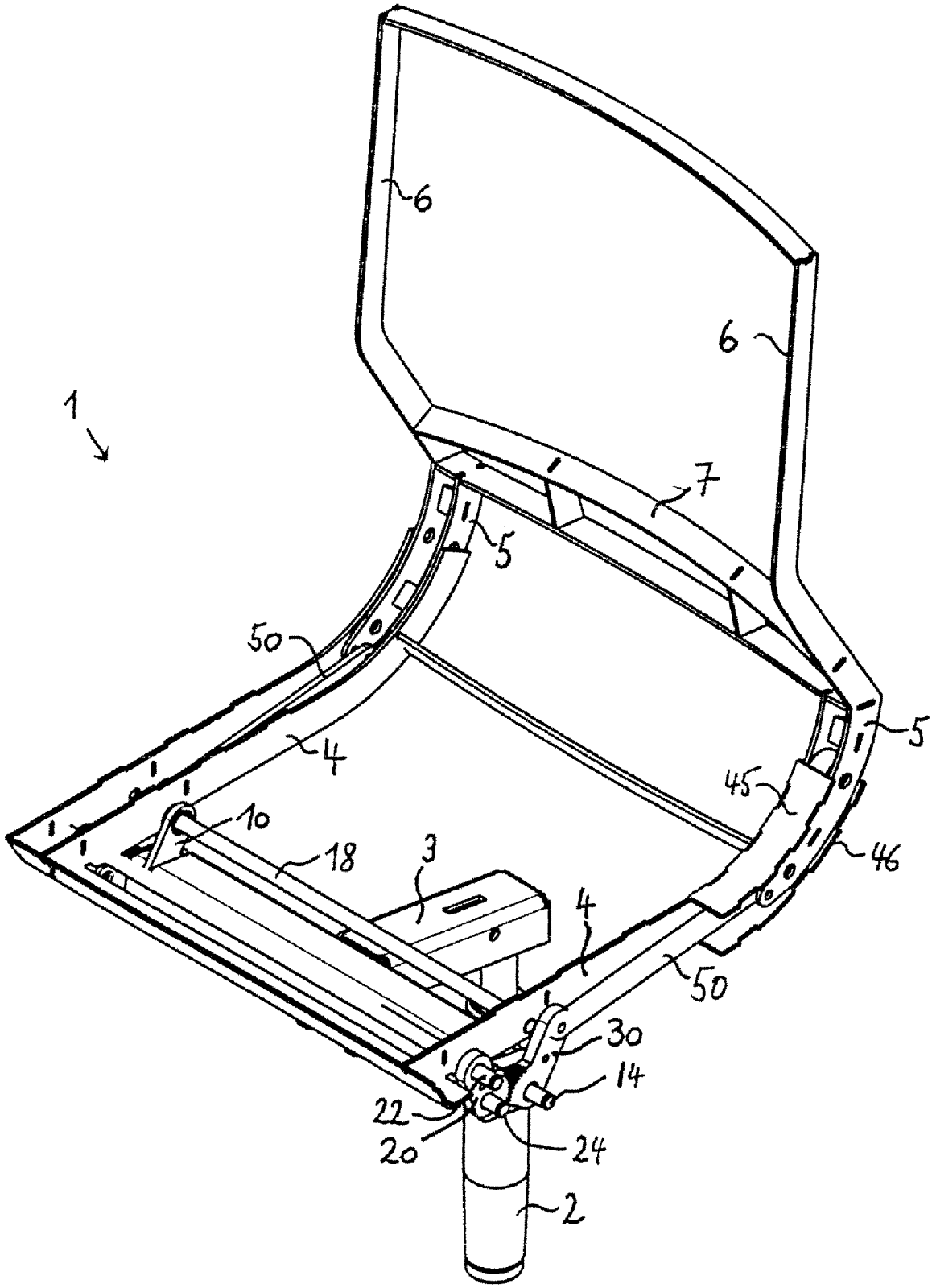
FIG. 1 is a perspective view of the mechanism of a first embodiment of a chair.

In this embodiment, on the one hand two pull spring levers 10, which are arranged on a rear seat coupling shaft 18, and on the other hand two coupling levers 20, which are arranged on a front seat coupling shaft 22, are arranged in an articulated manner on the seat carriers 4. The pull spring levers 10 are articulated to the base carrier via the main shaft 14, as are the coupling levers 20 via the base coupling shaft 24. Thus, the seat carrier 4 is connected to the base carrier 3 which is in turn connected to the chair foot 2.

In the embodiment shown, the back rest carriers 5 and the back rest 6 have or has in particular a stiffening element 7 in order to join together the two back rest carriers and to increase the dimensional stability of the back rest 6. The back rest 6 can be formed in one piece preferably with the back rest carriers 5 and in particular with the stiffening element 7.

A respective back rest carrier 5 is movably mounted between an upper arched guide 45 and a lower arched guide 46 which are each arranged on a seat carrier 4. A pull rod 50 is in each case arranged in an articulated manner on a back rest carrier 5 and articulated to a pull lever 30. The two pull levers 30 are arranged on the main shaft 14 and coupled to the coupling levers 20.

Figure 2:
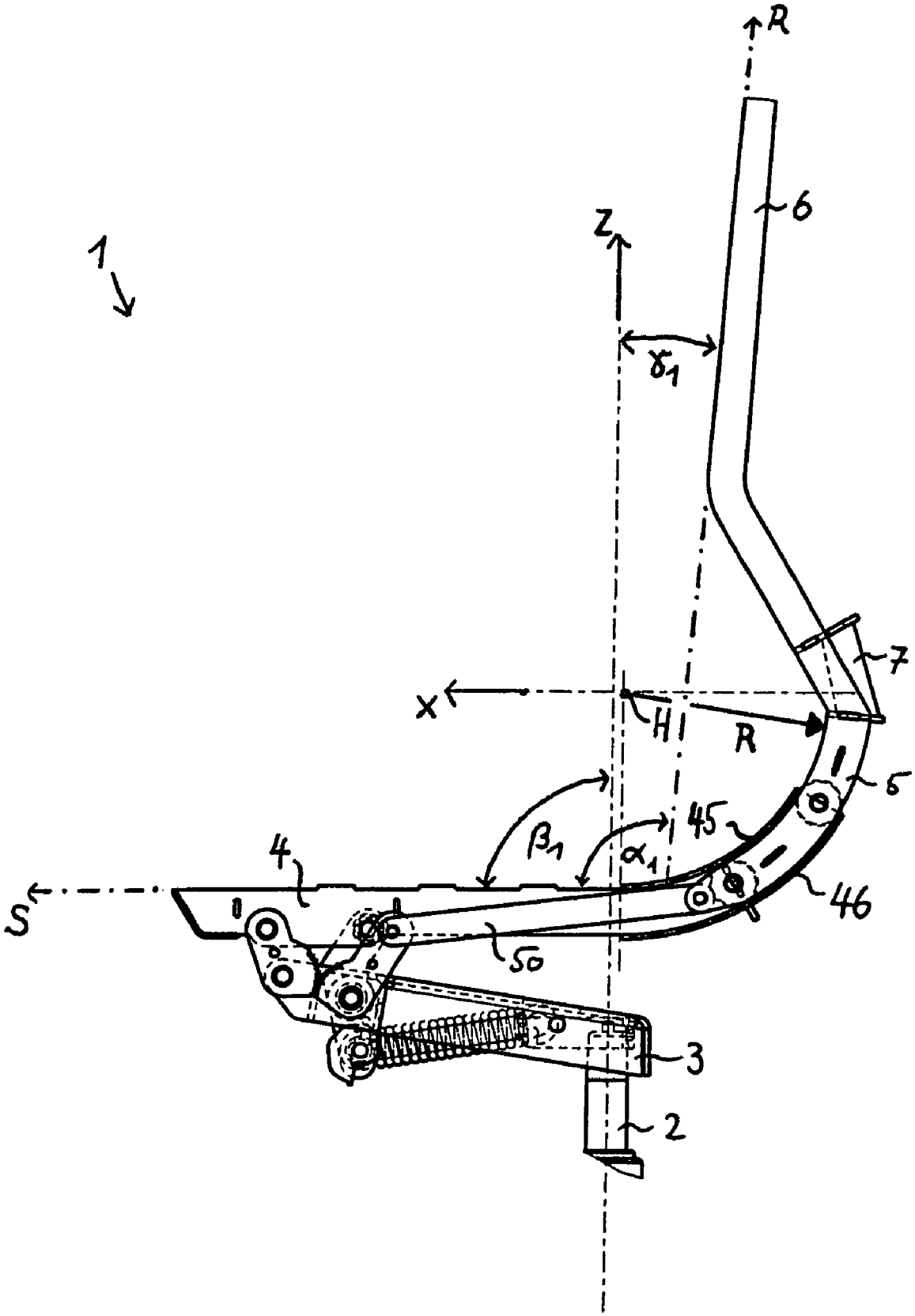
FIG. 2 is a side view of the mechanism of the embodiment of the chair in a first position.

FIG. 2 is a side view of the mechanism of the first embodiment of the chair 1 in a first position, as shown in FIG. 1. In the first position, the chair mechanism is in a position allowing a user to sit on the chair 1 in an upright sitting position.

The seat carrier 4 has a longitudinal extension S, which extends substantially parallel to the x direction and substantially perpendicularly to the z direction, and a second extension along the y direction, so that a plane spanned by the upper edge of the seat carrier 4 extends substantially horizontally. The seat carrier 4 is inclinable about a tilt axis extending along the y direction, so that a seat angle $\beta_1$ is enclosed between the z direction and the longitudinal extension S of the seat carrier 4, the angle $\beta_1$ in the first position being in the range of from approximately 80 to approximately 110 degrees, in particular approximately 90 degrees.

The back rest 6 has a longitudinal extension R, which extends substantially parallel to the z direction and substantially perpendicularly to the x direction, and a second extension along the y direction, so that a plane spanned by the back rest 6 extends substantially vertically. The back rest 6 is inclinable about a tilt axis or axis of rotation extending along the y direction. In particular, the back rest carrier 5 is circularly guided, at least in certain regions, by the upper and lower arched guide 45, 46. The common centre of the circle H of the arc of a circle portions of the upper and lower arched guide 45, 46 is in this case arranged set apart from the upper arched guide 45 at a radius $R_H$. The back rest 6 is accordingly mounted so as to be able to rotate about the centre of the circle H. In particular, no translatory relative movement takes place between the centre of the circle H and the back rest 6.

In the first position, a back rest angle $\gamma_1$ is enclosed between the z direction and the longitudinal extension R of the back rest 6, wherein the angle $\gamma_1$ is in the first position in the range of from approximately 0 to 25 degrees, in particular approximately 6 degrees. Accordingly, an opening angle $\alpha_1$, which is in the first position in the range of from approximately 80 to approximately 135 degrees, in particular approximately 96 degrees, is enclosed between the longitudinal extension R of the back rest 6 and the longitudinal extension S of the seat carrier 4.

The minimum back rest angle $\gamma$ of less than 25 degrees is attained when the pull rod 50 is in an extreme position counter to the x direction, i.e. at the rear. In this position, the centre of the circle H of the arched guides 45, 46 of the seat carrier 4 is in a spatial position close to the z axis of the chair foot 2. In particular, from the centre of the circle H, the distance counter to the z direction relative to the seat carrier 4 and the distance counter to the x direction relative to the back rest 6 or to the back rest carrier 5 is substantially the same size.

Figure 3:
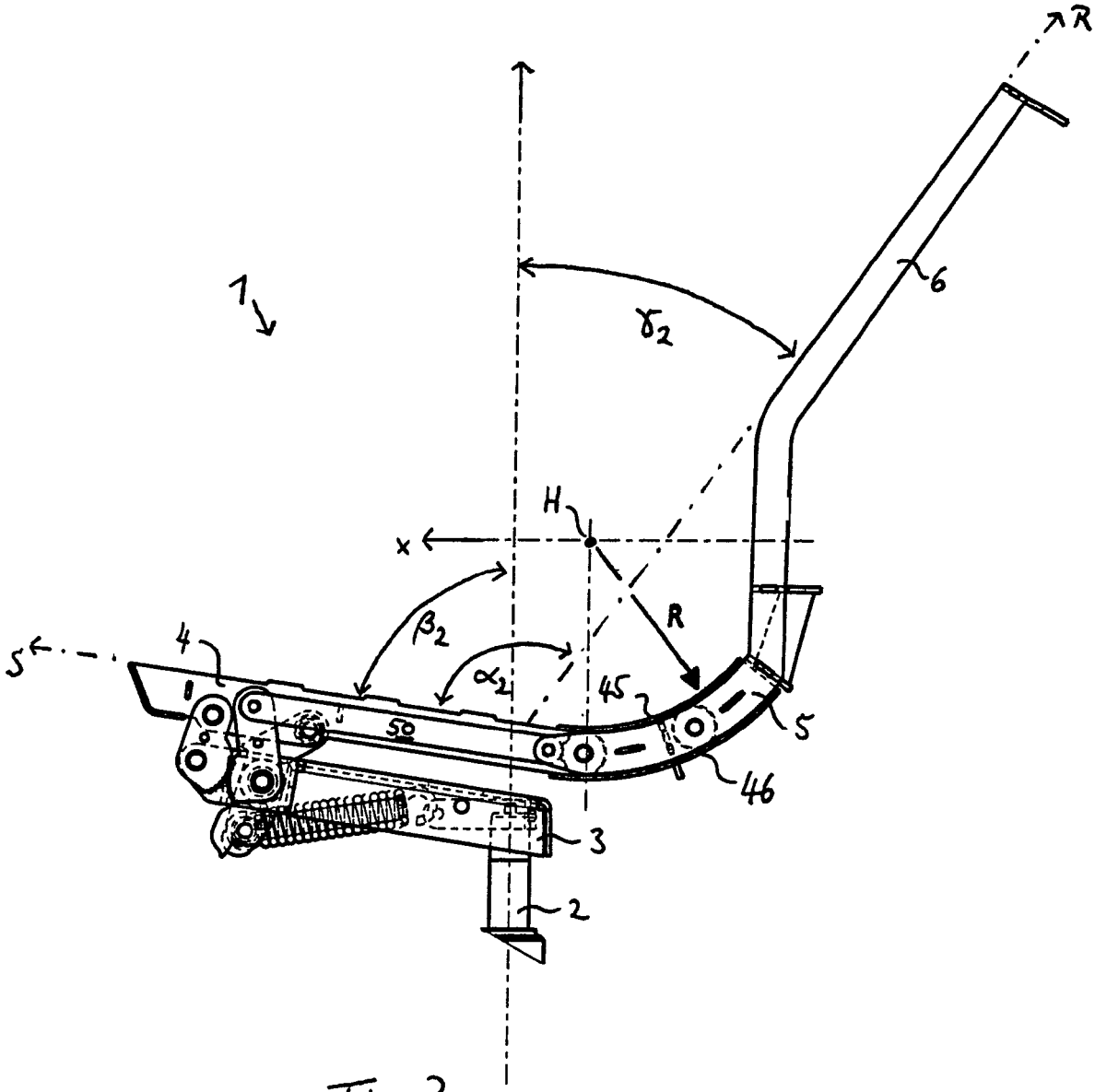
FIG. 3 is a side view of the mechanism of the first embodiment of the chair in a second position.

FIG. 3 is a side view of the mechanism of the first embodiment of the chair 1 in a second position. In the second position, the chair mechanism is in a position allowing a user to sit on the chair 1 in a reclined sitting position.

In the second position, the longitudinal extension S of the seat carrier 4 encloses with the z direction a seat angle $\beta_2$ of from approximately 70 to approximately 90 degrees, in particular approximately 80 degrees.

In the second position, the longitudinal extension R of the back rest 6 encloses with the z direction a back rest angle $\gamma_2$ of from approximately 20 to approximately 55 degrees, in particular approximately 36 degrees.

Accordingly, in the second position, an opening angle $\alpha_2$ of from approximately 90 to approximately 145 degrees, in particular approximately 116 degrees, is enclosed between the longitudinal extension R of the back rest 6 and the longitudinal extension S of the seat carrier 4.

The maximum back rest angle $\gamma_2$ is attained when the pull rod 50 is in an extreme position in the x direction, i.e. at the front. In this position, the centre of the circle H is in a spatial position which, compared to the first position, is set further apart, counter to the x direction, from the z axis of the chair foot 2. In particular, from the centre of the circle H, the distance counter to the z direction relative to the seat carrier and the distance counter to the x direction relative to the back rest 6 or to the back rest carrier 5 are substantially the same size in the second position too.

As the chair 1 passes from the first position to the second position, the changes in the seat angle $\Delta\beta=\beta_2-\beta_1$ and the back rest angle $\Delta\gamma=\gamma_2-\gamma_1$ are preferably at a constant ratio to one another. In this case, the ratio of the changes in angle $\Delta\gamma/\Delta\beta$ is in particular between approximately 2 and approximately 4, more preferably between approximately 2.5 and approximately 3.5 and particularly preferably approximately 3.

Furthermore, the centre of the circle H is displaced on passing from the first to the second position counter to the x direction, so that its distance from the back rest 6 is not increased in size.

Preferably, the centre of the circle H is arranged in such a way that it coincides with the spatial position of the pivot point D of the hip joint of a user of the chair 1. Preferably, the distance between H and D is less than approximately 5 cm, particularly preferably less than approximately 3 cm and in particular less than 2 cm. Preferably, the radius $R_H$ of the upper arched guide 45, i.e. the distance of the centre of the circle H from the seat carrier or from the back rest carrier, is in a range of from approximately 6 cm to approximately 20 cm, more preferably in a range of from approximately 8 cm to approximately 18 cm, particularly preferably in a range of from approximately 10 cm to approximately 15 cm, in particular in a range of from approximately 11 cm to approximately 13 cm.

Figure 4:
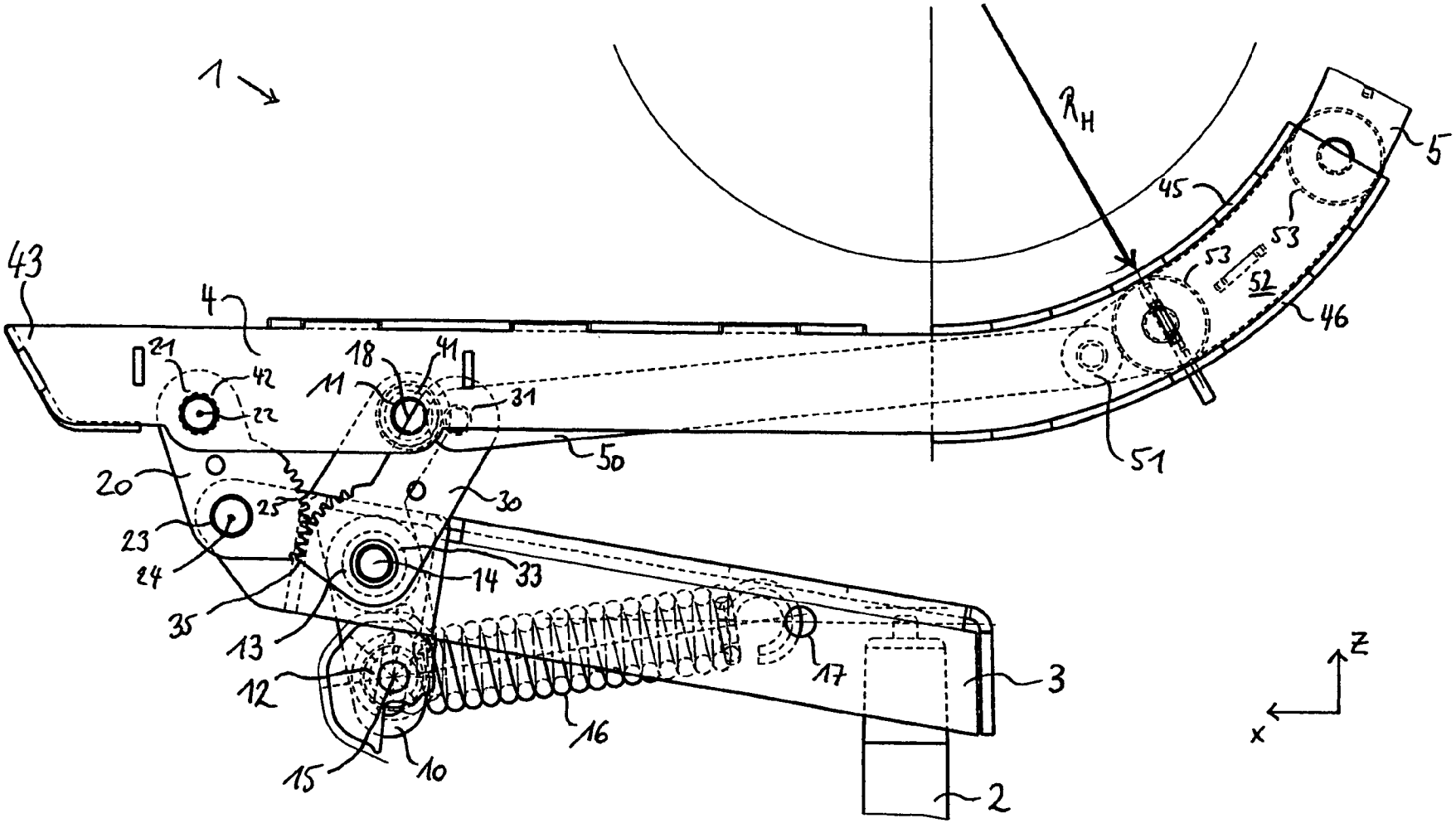
FIG. 4 is a detailed side view of the mechanism according to FIG. 2.

FIG. 4 is a detailed side view of the mechanism of the first embodiment of the chair in a first position, as shown in FIG. 2.

The seat carrier 4 is articulated to the base carrier 3 on the one hand via two pull spring levers 10 and on the other hand via two coupling levers 20. Each pull spring lever 10 has at one end a seat coupling shaft bearing, region 11, at the end opposite thereto a pull spring shaft bearing region 12 and therebetween a main shaft bearing region 13. Each pull spring lever 10 is rotatably connected to the base carrier 3 via the main shaft 14 which is mounted in the main shaft bearing region 13. Furthermore, the pull spring lever 10 is connected to the base carrier 3 via the pull spring shaft 15 which is mounted in the pull spring shaft bearing region 12, the pull spring 16 and the pull spring suspension 17. The seat coupling shaft bearing region 11 of the pull spring lever 10 is articulated to the seat carrier 4 via the seat coupling shaft 18 and the rear seat coupling bearing 41.

Each coupling lever has preferably a substantially angular form with two legs. The coupling lever 20 has furthermore at one end of a leg a seat coupling shaft bearing region 21 at which it is articulated to the seat carrier 4 via the front seat coupling shaft 22 and the front seat coupling bearing 42. Furthermore, the at least one coupling lever 20 has a base coupling shaft bearing region 23 which receives the base coupling shaft 24, so that the at least one coupling lever 20 is rotatably connected to the base carrier 3 via the base coupling shaft 24.

At one end of the other leg, the at least one coupling lever 20 has a first coupling means 25 which is designed to enter into engagement with a second coupling means 35 of a pull lever 30.

The at least one pull lever 30 has preferably an angular form with two legs. The at least one pull lever 30 has at one end of a leg a pull rod bearing region 31 at which a pull rod 50 is articulated to the pull lever 30. Furthermore, the at least one pull lever 30 has a main shaft bearing region 33 which receives the main shaft 14, so that the pull lever 30 is rotatably connected to the base carrier 3 via the main shaft 14.

At one end of the other leg, the at least one pull lever 30 has the second coupling means 35 which is designed to enter into engagement with the first coupling means 25 of the at least one coupling lever 20.

In the first embodiment, the first coupling means 25 is embodied as a series of equidistant projections or a toothing or row of teeth or as an arc of a circle portion of a gear wheel. The second coupling means 35 can in the first embodiment be embodied as an equidistant row, formed as a counterpart to the first coupling means, of recesses or as toothing or a row of teeth or else as an arc of a circle portion of a gear wheel, the first coupling means 25 being in engagement with the second coupling means 35.

Rotating the at least one pull lever 30 allows the pull rod 50, which is articulated thereto, to be moved substantially in or counter to the x direction. The pull rod 50 is connected to the back rest 5 via an articulated connection 51.

The back rest carrier 5 has a restrictedly guided region 52 which has guided elements 53 and is movable within an upper arched guide 45 and a lower arched guide 46 of the seat carrier 4, in particular is rotatable about the centre of the circle H. The guided elements 53 can in particular be configured as rollers which are arranged on axle stubs or shafts which are arranged in the restrictedly guided region 52. The rollers can be displaced between the upper arched guide 45 and the lower arched guide 46, in particular by rolling or sliding. If the diameter of the rollers is selected first to be smaller, for example by 1/10 to 1/2 millimetres, than the distance between the upper and lower arched guide 45, 46, then the displacement will advantageously be carried out substantially by rollers and thus in a particularly friction-free manner.

In the first position, the pull spring 16 is contracted and relaxed, wherein the at least one pull rod 50 is in an extreme spatial position in the x direction and the seat carrier extends substantially horizontally, i.e. substantially parallel to the x-y plane.

Figure 5:
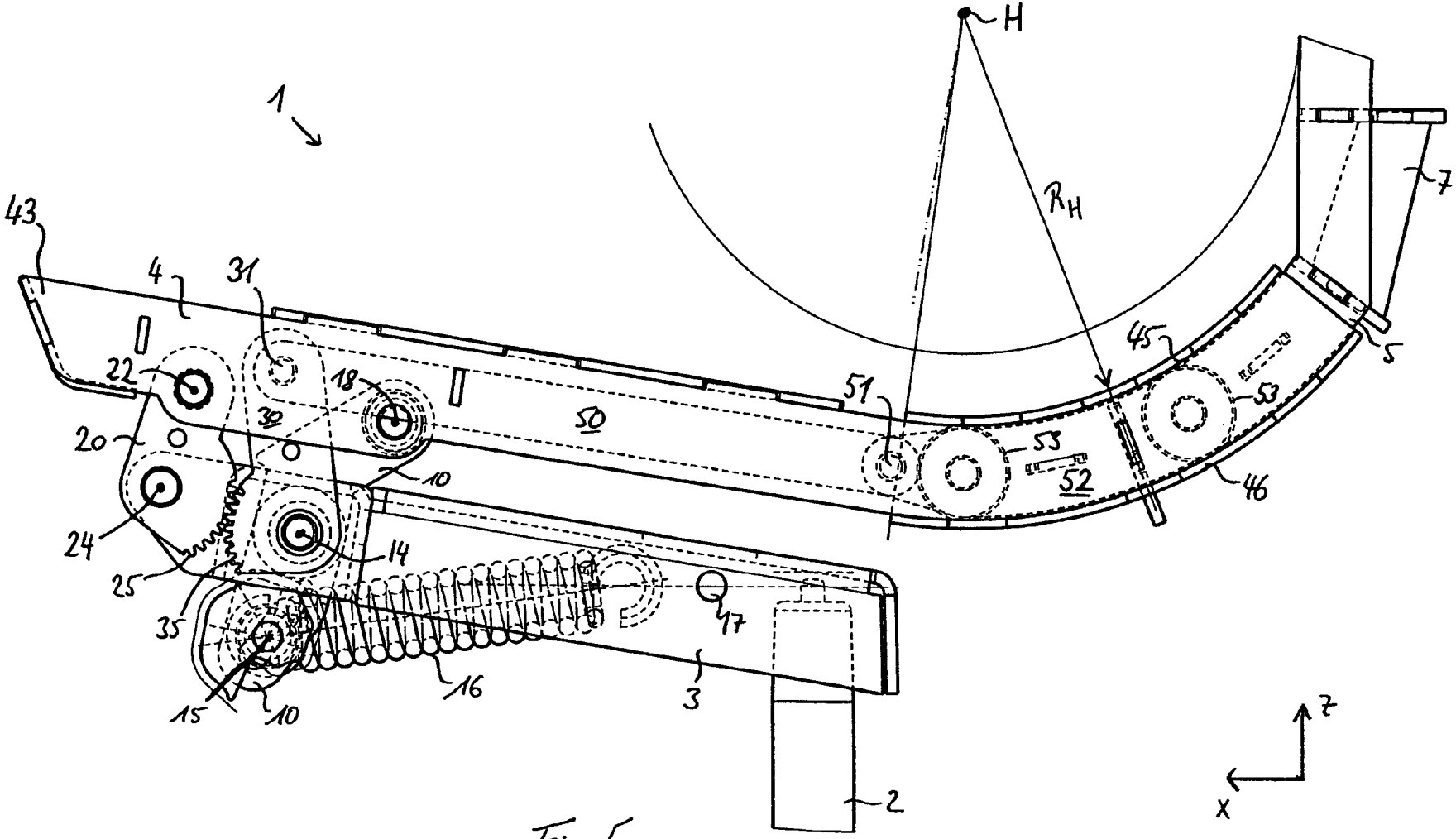
FIG. 5 is a detailed side view of the mechanism according to FIG. 3.

FIG. 5 is a detailed side view of the mechanism of the first embodiment of the chair 1 in a second position, as shown in FIG. 3.

As may be seen from the figure, the continuous passing of the seat carrier 4 up to the back rest carrier 5 via the upper arched guide 45 is preserved during the passing from the first position from FIG. 4 to the second position. In other words, the arched guides 45, 46 prevent a translatory movement of the back rest carrier 5 or the back rest 6 along the direction of the radius vector $R_H$. This advantageously prevents the formation, in the region of the transition between the seat carrier and back rest, of any discontinuity or an edge in the covering of the chair, which would disadvantageously lead to a reduction in sitting comfort.

Furthermore, FIGS. 4 and 5 show that the front edge 43 of the seat carrier 4 is displaced relative to the front seat coupling shaft 22 in the z direction, i.e. upward in order to avoid raising of the lower thigh or the knee of the user of the chair as he reclines, the front seat coupling shaft 22 is displaced as a result of the rotation of the coupling lever 20 accordingly counter to the z direction, i.e. downward. Preferably, the position of the front edge 43 of the seat carrier remains substantially constant, i.e. it is displaced in terms of amount along the z direction less than approximately 2 cm, more preferably less than approximately 1 cm and particularly preferably less than approximately 5 mm.

Figure 6:
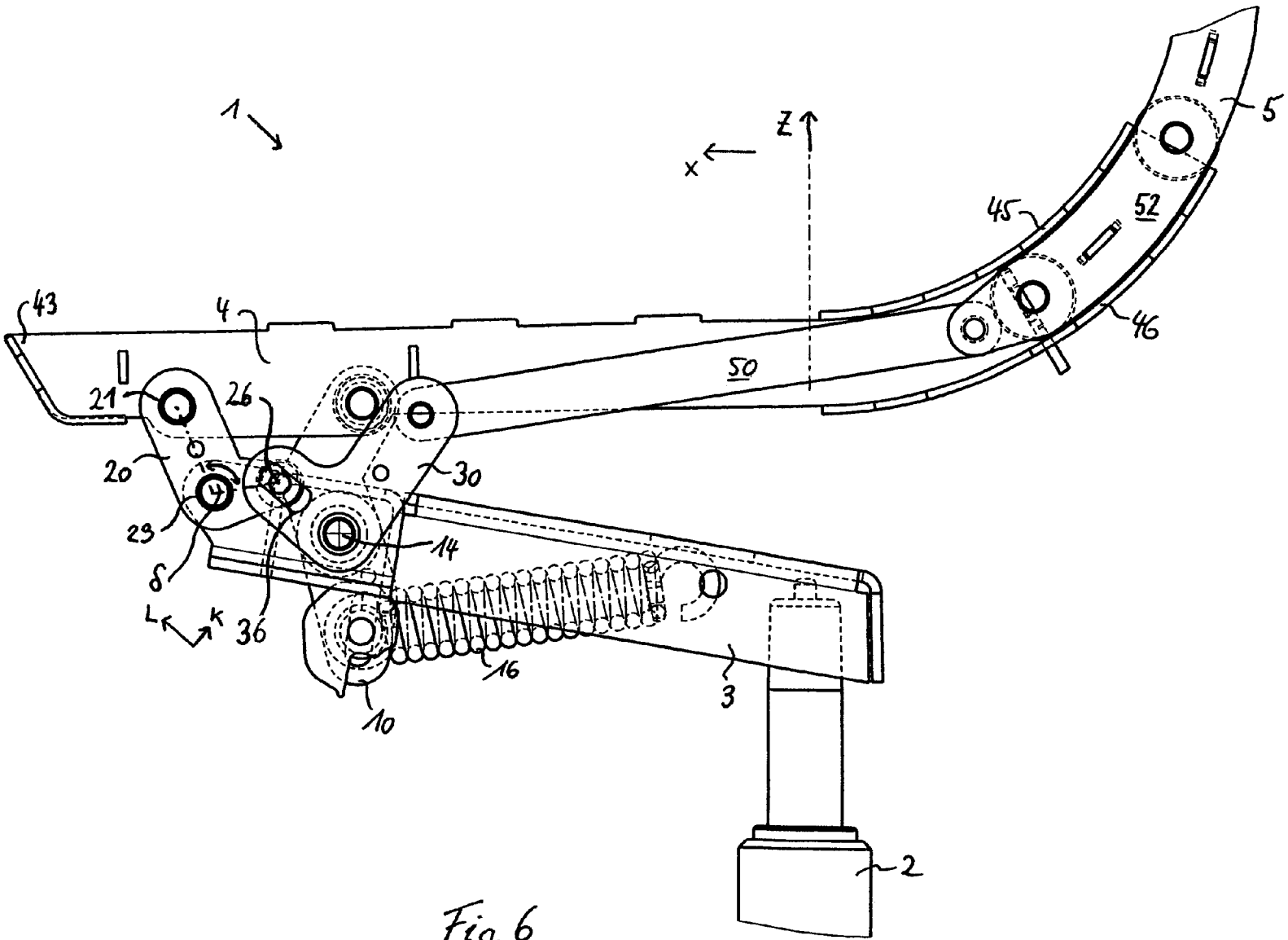
FIG. 6 is a detailed side view of the mechanism of a second embodiment of the chair in a first position.

FIG. 6 is a side view of the mechanism of a second embodiment of the chair 1 in a first position. The chair 1 is in this case embodied substantially in accordance with the first embodiment, such as is shown in particular in FIG. 4. The parts corresponding to FIG. 4 are therefore provided with the same reference numerals.

In the second embodiment, the at least one coupling lever 20 has a preferred first coupling means 25 and the at least one pull lever 30 has a preferred second coupling means 35, the coupling means 25, 35 being designed to enter into engagement with each other.

In the second embodiment, the first coupling means 25 is embodied as a journal 26 or axle stub 26. Preferably, the connecting line between the journal 26 and the base coupling shaft bearing region 23 and also the connecting line between the seat coupling shaft bearing region 21 and the base coupling shaft bearing region 23 enclose an angle δ which is different from 180 degrees. Particularly preferably, δ is between approximately 30 and approximately 150 degrees and particularly preferably between approximately 80 and approximately 110 degrees.

The second coupling means 35 is embodied in the second embodiment as a recess 36 in the pull lever 30, with which recess the journal 26 engages. The recess 36 is embodied preferably in an elongate manner, in particular substantially rectangularly, so that the extension in the direction K of the short side of the recess 36 is approximately equal to the diameter of the journal 26. The recess 36 is arranged in such a way that the direction L of the longitudinal extension, i.e. the extension in the direction of the long side, of the recess 36 coincides with a radius vector, emanating from the main shaft 14, of the main shaft 14. As a result, the journal 26 is movable substantially only in or counter to the direction L of the longitudinal extension of the recess 36, i.e. radially away from or toward the main shaft 14. Therefore, a force can be transmitted by the journal 26 onto the edge of the recess 36 in or counter to the direction K or from the edge of the recess 36 onto the journal 26. The action of this force allows the pull lever 30 to rotate about the main shaft 14, as this force acts on the pull lever 30 tangentially, i.e. perpendicularly to a radius vector, relative to the main shaft 14.

Figure 7:
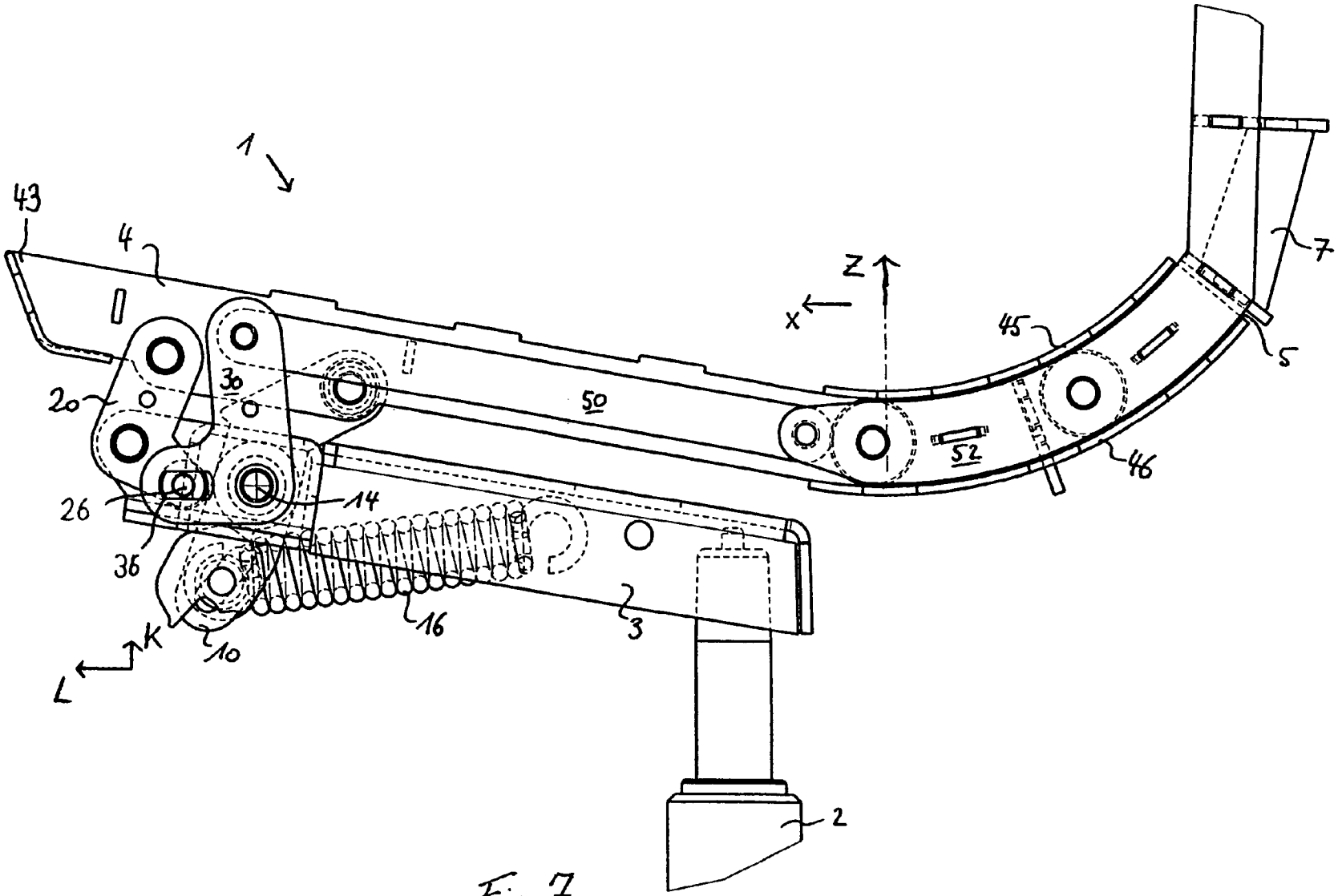
FIG. 7 is a detailed view of the mechanism of the second embodiment of the chair in a second position.

FIG. 7 is a side view of the mechanism of a second embodiment of the chair 1 in a second position similar to the position shown in FIGS. 3 and 5. In the embodiment shown in FIGS. 6 and 7 too, the seat coupling shaft 22 is displaced, as the back rest carrier 5 reclines, counter to the z direction, i.e. downward, in order to avoid raising of the lower thigh or the knee of the user of the chair by the front edge 43 of the seat carrier during reclining.

The present description of the preferred embodiments is not restricted to the above-described respective figures. On the contrary, the discussion concerning the respective figures applies analogously also to the further figures. Likewise, the statements made concerning the figures also apply to the preceding aspects and embodiments. Thus, further preferred embodiments can be formed by means of the individual features described with reference to the (respective) figures and/or by means of the individual features of the aspects and/or (individual features of) embodiments, wherein the individual features can be combined with one another in any desired manner.

The invention claimed is:

1. A chair comprising:

at least two seat carriers, each further comprising an upper arched guide and a lower arched guide;

at least two back rest carriers, each further comprising a restrictedly guided region;

a back rest arranged on the back rest carriers, wherein the restrictedly guided region of the back rest carriers is respectively guided between the upper arched guide and the lower arched guide of the corresponding seat carriers, thus allowing the back rest carriers to be inclined relative to the seat carriers, wherein the upper arched guide and the lower arched guide are embodied at least in certain regions as an arc of a circle portion and wherein the arc of a circle portion of the upper arched guide and the arc of a circle portion of the lower arched guide have the same centre of a circle;

a base carrier;

at least one pull spring lever which is articulated to the seat carrier by means of a rear seat coupling shaft;

at least two coupling levers which are articulated to the seat carrier by means of a front seat coupling shaft, wherein the at least one pull spring lever is articulated by means of a main shaft and the at least two coupling levers are articulated to the base carrier by means of a base coupling shaft;

at least two pull rods which are arranged in an articulated manner on the at least one back rest carrier and at least two pull levers which are arranged on the main shaft and which are each articulated to the at least two pull rods.

2. Chair according to claim 1, wherein the upper arched guide, the lower arched guide and the back rest carrier are designed in such a way that the back rest carrier and the back rest are movable exclusively along a circular path about the centre of the circle.

3. Chair according to claim 1, wherein the seat carrier and the back rest are designed in such a way that the pivot point of the hip joint of a user of the chair coincides substantially with the spatial position of the centre of the circle.

4. Chair according to claim 1, wherein the distance between a floor area on which the chair is standing and the front seat coupling shaft is variable on inclination of the back rest carriers and/or the seat carriers.

5. Chair according to claim 1, wherein the chair mechanism is embodied substantially mirror-symmetrically to a plane in the x-z direction running through the centre axis of the chair foot.

6. Chair according to claim 1, wherein the at least two coupling levers each have a first coupling means which is designed to enter into an engagement with a second coupling means of one of the at least two pull levers.

7. Chair according to claim 6, wherein the first coupling means is embodied as a series of equidistant projections or as a series of equidistant recesses.

8. Chair according to claim 6, wherein the first coupling means is embodied as a row of teeth or as an arc of a circle portion of a gear wheel.

9. Chair according to claim 1, wherein the seat carrier can be inclined about a tilt axis, so that a seat angle of from approximately 70 to approximately 110 degrees is enclosed between the z direction and the longitudinal extension of the seat carrier.

10. Chair according to claim 1, wherein the back rest can be inclined about a tilt axis, so that a back rest angle of from approximately 0 to approximately 55 degrees is enclosed between the z direction and the longitudinal extension of the back rest.

11. Chair according to claim 10, wherein the changes in the seat angle ($\Delta\beta=\beta2-\beta1$) and the changes in the back rest angle ($\Delta\gamma=\gamma2-\gamma1$) are at a constant ratio to one another, wherein the ratio $\Delta\gamma/\Delta\beta$ is between approximately 2and approximately 4.

* * * * *